US011021807B2

(12) United States Patent
Ida et al.

(10) Patent No.: US 11,021,807 B2
(45) Date of Patent: Jun. 1, 2021

(54) ELECTROLYTIC POLISHING METHOD AND DEVICE

(71) Applicants: MARUI GALVANIZING CO., LTD., Hyogo (JP); HIGASHI NIHON KIDENKAIHATSU CO., LTD., Iwate (JP); WING CO., LTD., Iwate (JP)

(72) Inventors: Yoshiaki Ida, Hyogo (JP); Takanori Yamaguchi, Hyogo (JP); Vijay Chouhan, Hyogo (JP); Keisuke Nii, Hyogo (JP); Goh Mitoya, Iwate (JP); Takao Akabori, Iwate (JP); Ken-ichi Miyano, Iwate (JP); Fukumi Takahashi, Iwate (JP); Yasunori Anetai, Iwate (JP); Hitoshi Hayano, Ibaraki (JP); Hideaki Monjushiro, Ibaraki (JP); Shigeki Kato, Ibaraki (JP); Takayuki Saeki, Ibaraki (JP)

(73) Assignees: Marui Galvanizing Co., Ltd., Hyogo (JP); Higashi Nihon Kidenkaihatsu Co., Ltd., Iwate (JP); Wing Co., Ltd., Iwate (JP)

( * ) Notice: Subject to any disclaimer, the term of this patent is extended or adjusted under 35 U.S.C. 154(b) by 86 days.

(21) Appl. No.: 16/612,814

(22) PCT Filed: Jan. 24, 2019

(86) PCT No.: PCT/JP2019/002257
§ 371 (c)(1),
(2) Date: Nov. 12, 2019

(87) PCT Pub. No.: WO2019/151102
PCT Pub. Date: Aug. 8, 2019

(65) Prior Publication Data

US 2020/0199771 A1 Jun. 25, 2020

(30) Foreign Application Priority Data

Feb. 2, 2018 (JP) ..... JP2018-017023

(51) Int. Cl.
*C25F 3/16* (2006.01)
*C25F 7/00* (2006.01)

(52) U.S. Cl.
CPC . *C25F 3/16* (2013.01); *C25F 7/00* (2013.01)

(58) Field of Classification Search
CPC ..... C25F 3/16; C25F 3/26; C25F 7/00
See application file for complete search history.

(56) References Cited

U.S. PATENT DOCUMENTS 9,987,699 B2 * 6/2018 Taylor ..... C25F 3/26
10,246,792 B2 * 4/2019 Ida ..... C25F 3/26
(Continued)

FOREIGN PATENT DOCUMENTS

JP 60208496 A * 10/1985
JP 61-23799 2/1986
(Continued)

OTHER PUBLICATIONS

International Search Report dated Mar. 12, 2019 in International (PCT) Application No. PCT/JP2019/002257.
(Continued)

*Primary Examiner* — Brian W Cohen
(74) *Attorney, Agent, or Firm* — Wenderoth, Lind & Ponack, L.L.P.

(57) ABSTRACT

The purpose of the present invention is to further level the amount of polishing during electrolytic polishing of the inside of a hollow pipe. A holding frame for vertically
(Continued)

holding a hollow pipe is pivotally supported on a rack so as to be vertically invertible about the vertical center of the hollow pipe. An electrode is inserted through the hollow pipe and a liquid buffer is disposed on each end of the hollow pipe. A valve mechanism is capable of switching a liquid supply/discharge circuit so as to supply an electrolyte via the liquid buffer positioned at the bottom and discharge the electrolyte via the liquid buffer positioned at the top whether it is before or after the inversion of the holding frame (inversion of the hollow pipe). During an electrolyte supply period before and after the inversion, an electrolytic treatment is as a matter of course carried out for a predetermined length of time. Although said switching by the valve mechanism may be manually performed, a control means may also be used.

5 Claims, 10 Drawing Sheets

(56) References Cited

U.S. PATENT DOCUMENTS

| | | | | |
|---|---|---|---|---|
| 2003/0098245 | A1* | 5/2003 | Lin | C25F 7/00 205/640 |
| 2015/0159294 | A1 | 6/2015 | Ida | |

FOREIGN PATENT DOCUMENTS

| | | |
|---|---|---|
| JP | 11-350200 | 12/1999 |
| JP | 5807938 | 11/2015 |

OTHER PUBLICATIONS

Translation of Written Opinion of the International Searching Authority dated Mar. 12, 2019 in International (PCT) Patent Application No. PCT/JP2019/002257.

* cited by examiner

ELECTROLYTIC POLISHING METHOD AND DEVICE

TECHNICAL FIELD

The present invention relates to an electrolytic treatment, and in particular, to device and method in connection with the electrolyte circulation for the electrolytic polishing or the electrolytic plating.

BACKGROUND ART

A linear collider is being constructed as a facility for creating a state of Big Bang (International Linear Collider (ILC) Project). The linear collider, as shown in FIG. 10, uses a hollow pipe 100 made of niobium, that is provided with flanges 101*a* and 101*b* at both ends and has a diameter changing periodically in an axial direction. There are elements to obtain a predetermined effect in this experiment, and one is whether or not the inside of the niobium hollow pipe 100 is to be smooth.

The hollow pipe 100, however, is subjected to excessive pressure and heat at forming, so that an inside surface becomes distorted unevenly. If such condition of the surface is left alone, the electric properties and the magnetic properties become uneven, with the result that it is not possible to impart a predetermined speed to the electrons and the positrons. Accordingly, methods for polishing the inside of the hollow pipe in a predetermined thickness have been developed as a countermeasure against such problem.

Generally, the chemical polishing and the electrolytic polishing are employed as the polishing method for not only the niobium hollow pipe but also the above-mentioned hollow pipe. In the present invention, the electrolytic polishing is described.

In case of electro-polishing the inside of the above-mentioned hollow pipe, in particular, the pipe having a non-straight and complicated inside shape, it becomes very important to treat bubbles generated from the electrolyte. In other words, when the bubbles are dwelling in the pipe, the inside of the pipe holding the bubbles becomes a rough condition and the surface does not become satisfied condition.

Japanese Unexamined Patent Application Publication No. 61-23799 discloses a device for electro-polishing the inside of the hollow pipe (a metallic hollow body) having a cell in a center of a longitudinal direction of the pipe (referred to as the "cell", hereinafter). The device is configured to insert a liquid supply pipe to the center of the metallic hollow body while keeping the hollow pipe horizontally in the longitudinal direction, and supply the electrolyte from an end of the liquid supply pipe to the cell, wherein the electrolyte is supplied so as to immerse a lower half of the inside of the hollow body in the electrolyte by rotating the hollow body on a central axis of the hollow body. Here, the electrolyte is supplied from an end of the liquid supply pipe running through the center of the hollow body to the cell through a supply port disposed on a downside of the liquid supply pipe so as to face to the cell, and discharged from an other opening port of the hollow body. Under such configuration the state of the electrolyte flow to be supplied into the cell differs depending on a position, so that it occurs that the state of the polishing becomes uneven.

In order to improve the above-mentioned disadvantage and level the state of polishing, the invention disclosed in Japanese Unexamined Patent Application Publication No. 11-350200 is configured to supply the electrolyte in the perpendicular and upward direction from an upper side of the liquid supply pipe so as not to generate the flow of the electrolyte in the cell.

When the hollow pipe is placed horizontally in the longitudinal direction as above, however, it occurs that an upper half of the pipe is not immersed in the electrolyte. It is difficult to take no account of surface roughness caused by bubbles generated at the electrolysis. In Japanese Patent No. 5,807,938, the applicant of the present invention discloses a device for the electrolytic treatment (the electrolytic polishing and the electrolytic plating) while an axis of the hollow pipe is placed vertically so as to immense the whole of the inside of the hollow pipe in the electrolyte.

CITATION LIST

Patent Literature

Patent Literature 1: Japanese Unexamined Patent Application Publication No. 61-23799,
Patent Literature 2: Japanese Unexamined Patent Application Publication No. 11-350200, and
Patent Literature 3: Japanese Patent No. 5,807,938.

DISCLOSURE OF THE INVENTION

Problems to be Solved by the Invention

When using the device for performing the electrolytic polishing in the state that the axis of the hollow pipe is placed vertically, which is disclosed in the Japanese Patent No. 5,807,938, it is possible to polish the inside of the hollow pipe evenly to some extent, but it is insufficient when the precision level is required.

In case of polishing the hollow pipe having the cells of which diameters change periodically by using the device disclosed in Japanese Patent No. 5,807,938, the amount of polishing are measured at positions (m1 to m6, FIG. 5) and the results are indicated in FIG. 7. A bulge from a small diameter part to another small diameter part is referred to the cell, hereinafter.

A series of 9 cells, each cell having 300 mm of the large diameter and 100 mm of the small diameter, is polished under 27 mA current for 3 minutes while supplying the electrolyte from a lower end and discharging the electrolyte from an upper end. The process is repeated in predetermined times. In this case, about 200 cc of gases (hydrogen gas) is generated per 1 minute in each cell, and the gases raise up together with the supplied electrolyte, so that the amount of gas increases in the upper position of the cell.

Under such condition, when measuring the amount of polishing at 6 points in the axis direction of each cell as shown in FIG. 5 (m1 to m6), that is, at 54 points of the 9 cells, it is understood, as shown in FIG. 7, that the most polished part of each cell is a part above the large diameter part (corresponding to a shoulder part of each cell of the hollow pipe, in FIG. 5), and there is a large difference of the amount of polishing depending on the positions of the inside of the cell. Looking through the plural cells, the above-mentioned part of the cell nearer to the upper end of the pipe (left, FIG. 7) has a larger amount of polishing. When comparing the amount of polishing between the cell near to the lower end (right, FIG. 7) and the cell near to the upper end, the difference of the amount of polishing is a little over 50 μm at the shoulder part and about 5 μm at the small diameter part.

As described above, in case of using the device in Japanese Patent No. 5,807,938, it is possible to ensure to level the amount of polishing of the inside of the cell or between the cells to some extent, however, it is insufficient when the further strictness is required.

The present invention is proposed in view of the above conventional problems, and has an object to provide with the electrolytic polishing device and electrolytic polishing method to control the amount of polishing depending on the position inside the cell, and reduce the difference of the amount of polishing between the cells.

Means of Solving the Problems

The present invention relates to the electrolytic polishing device for electrolytic polishing the hollow pipe.

Holding frames hold the hollow pipe vertically, and are pivotally supported on a rack so as to be vertically invertible about the vertical center of the hollow pipe. An electrode is inserted in the hollow pipe, and liquid buffers are disposed at upper and lower ends of the hollow pipe.

A valve mechanism switches a liquid circulation circuit so as to circulate an electrolyte in the hollow pipe from the lower liquid buffer to the upper liquid buffer, regardless of before and after the inversion of the invertible hollow pipe. Under such configuration, the electrolytic treatment is performed for a predetermined period while circulating the electrolyte in the hollow pipe before the inversion of the hollow pipe, and then the electrolytic treatment is performed for the predetermined period while circulating the electrolyte in the hollo tube after the inversion of the hollow pipe.

The switching of the valve mechanism may be carried out manually, or may use a switching control unit. In addition, the electrolytic treatment can be carried out by an electrolytic treatment control unit.

The steps of the electrolytic polishing using the above-mentioned device can be recognized as an invention of process. Specifically, in a state of circulating the electrolyte in the hollow pipe from the lower liquid buffer to the upper liquid buffer, the electrolytic polishing is performed for a predetermined period. Next, the electrolytic polishing and the circulation of the electrolyte are suspended. And then, the hollow pipe is inverted. In a state that the hollow pipe is inverted, the electrolytic polishing is performed for the predetermined period while circulating the electrolyte in the hollow pipe from the lower liquid buffer to the upper liquid buffer.

The above-mentioned steps are repeated as many times as necessary.

Effects of the Invention

According to the above-mentioned configuration, the electrolytic treatment is performed while inverting the hollow pipe at predetermined time interval as well as circulating the electrolyte from a bottom of the hollow pipe and pushing out upwardly the bubbles generated by the electrolytic treatment together with the circulating electrolyte, so that it is possible to control the unevenness of the amount of polishing depending on the inside position of the cell constituting the hollow pipe and the position between the cells.

BEST MODE FOR CARRYING OUT THE INVENTION

<Structure>

Figure 1:
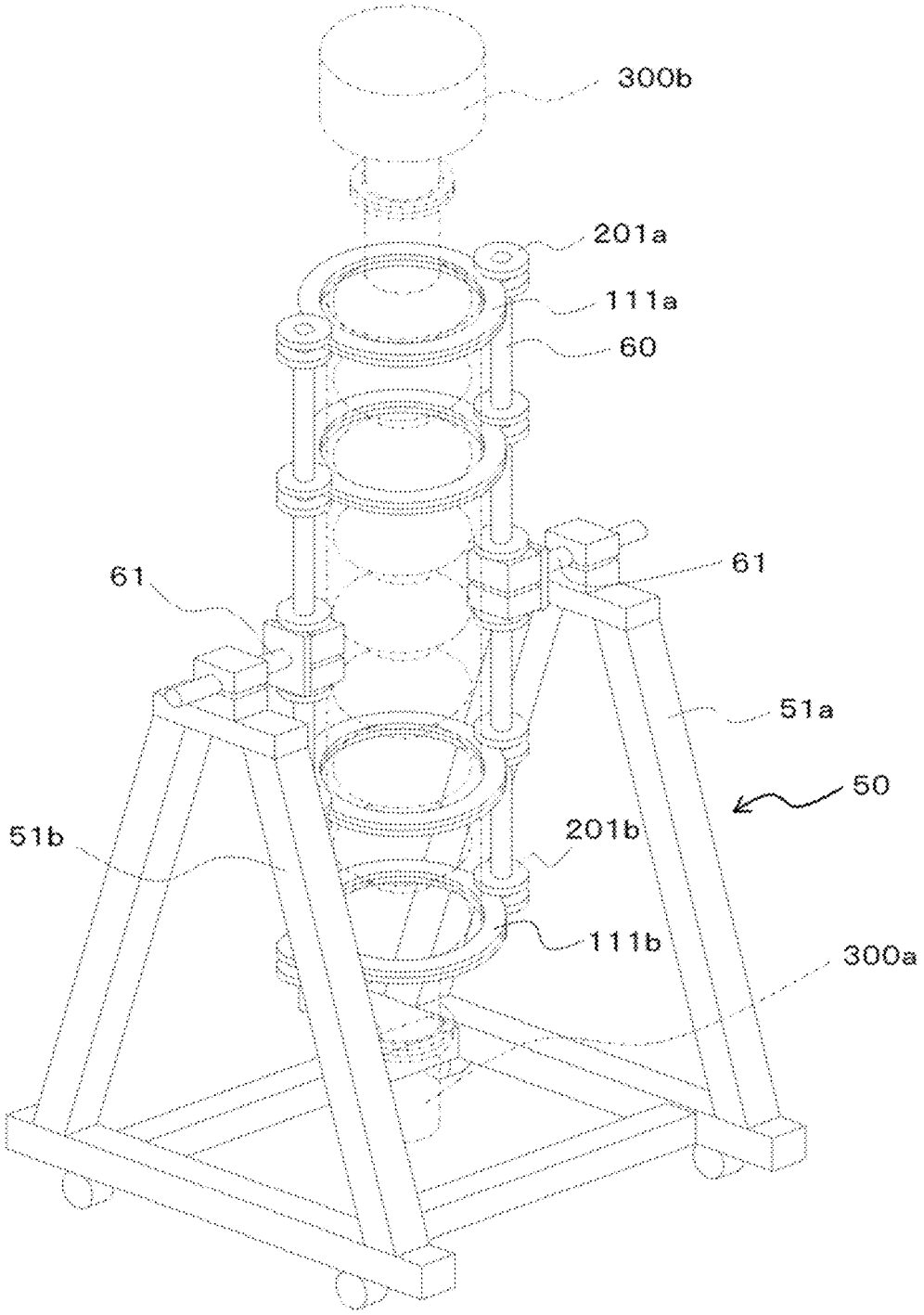
FIG. 1 is a perspective view showing a device of the present invention.
Figure 2:
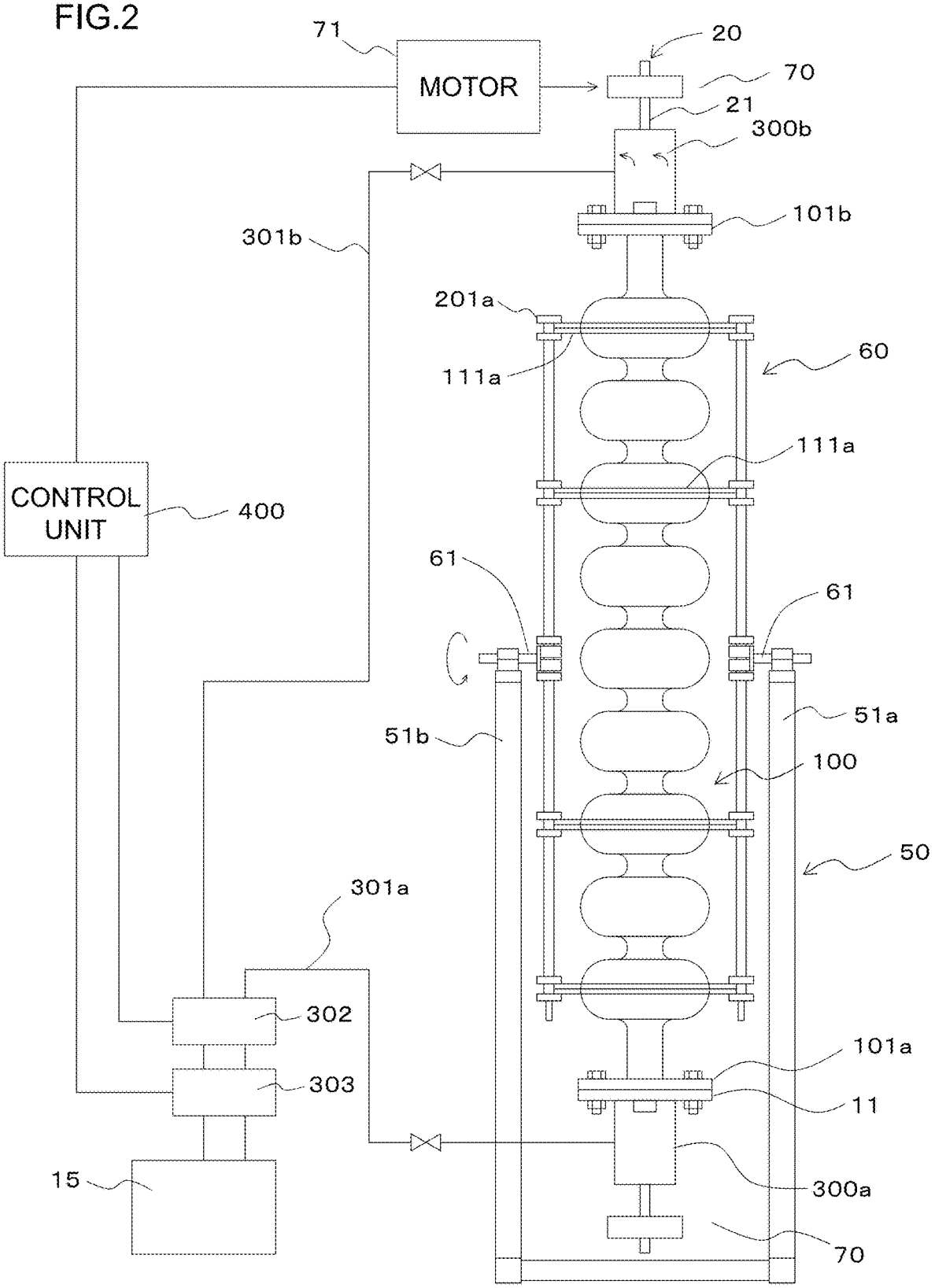
FIG. 2 is a schematic view of the present invention.

FIG. 1 is a perspective view showing an outline of the present invention, and FIG. 2 is a schematic view showing a liquid supply/discharge circuit and a control unit for electrolyte of the device shown in FIG. 1.

A rack 50 has right and left props 51*a* and 51*b* standing a predetermined height and spacing out a predetermined interval. Right and left holding frames 60 are supported at each center of the vertical direction (an axis direction of the hollow pipe) by the right and left props 51*a* and 51*b* of the rack 50 via a horizontal rotating axis 61.

Flanges 111*a* and 111*b* are mounted in large diameter parts of the cells positioned at upper and lower ends of the hollow pipe 100. The flanges 111*a* and 111*b* are pinched by clips 201*a* and 201*b* attached to the holding frames 60, and thereby the flanges 111*a* and 111*b* are fixed on the holding frames 60. Accordingly the hollow pipe 100 is set to the holding frames 60. Besides, the positions of fixing the hollow pipe 100 on the holding frames 60 are not limited to the upper and lower flanges 111*a* and 111*b*, if necessary, the hollow pipe 100 may be fixed on the holding frames 60 at any part to be reinforced by means of the same flanges and clips.

The above described flanges 111*a* and 111*b* are divided into two parts in the diameter direction. The two divided flanges are connected each other with screws and so on at the diameter part of the cell of the hollow pipe 100, so that each flange 111*a* and 111*b* can be fixed on the hollow pipe 100.

At the upper and lower ends of the hollow pipe 100, liquid buffers 300*a* and 300*b* are disposed using flanges 101*a* and 101*b*, and the liquid buffers 300*a* and 300*b* are respectively connected with circulation pipes 301 (a liquid supply pipe 301*a* and a liquid discharge pipe 301*b* that are described hereinafter). The two circulation pipes 301 are connected with a liquid tank 15 through a valve mechanism 302 and a pump 303. Besides, the valve mechanism 302 shown in FIG. 2 includes all valves illustrated in FIG. 3 described after, but the valve mechanism 302 in this embodiment means three-way valves 302*a* and 302*b* mainly.

The circulation pipe 301 consists of the liquid supply pipe 301*a* and the liquid discharge pipe 301*b*, since the hollow pipe 100 is inverted upside down at a predetermined intervals as described later, a pipe on a side to be connected with the liquid buffer 300*a* at the lower end of the hollow pipe 100 becomes the liquid supply pipe 301*a* and the other pipe on the other side to be connected with the liquid buffer 300*b* at the upper end of the hollow pipe 100 becomes the liquid discharge pipe 301*b*.

Considering the necessity of rotating an electrode 20 during the electrolytic treatment and the inverting of the hollow pipe 100 as described hereinafter, coupling members 70 (for example, gear units) connected with a motor for rotating the electrode 20 are arranged on both ends of an electrode axis 21 of the electrode 20.

Figure 3:
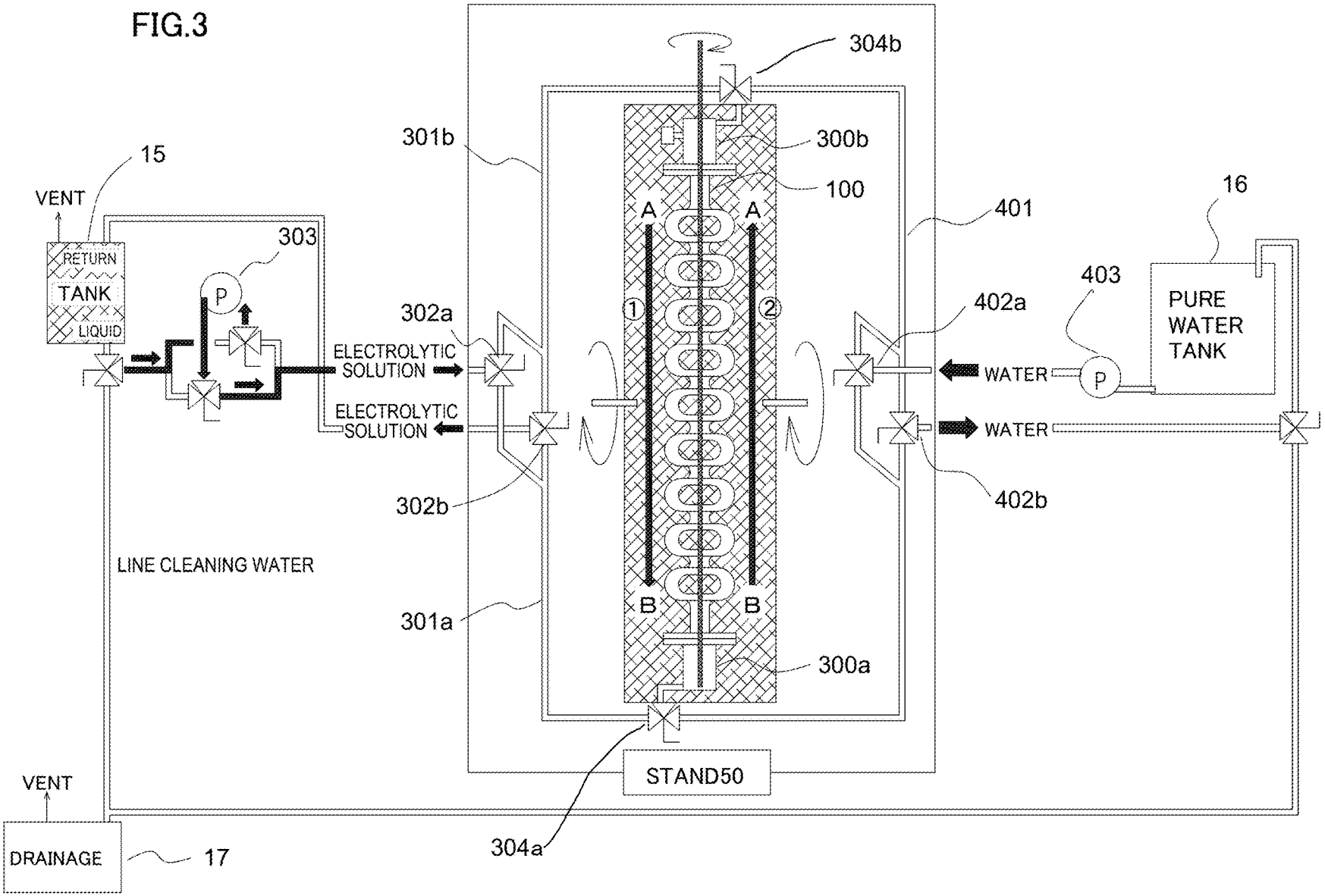
FIG. 3 is a detailed view of a liquid supply circuit.

FIG. 3 is a view more precisely showing the circuit for supplying the electrolyte to the hollow pipe 100 shown in FIG. 2.

Two ports of the 3-way valve 302*a* for supplying the liquid are connected each other so as to couple the liquid supply pipe 301*a* and the liquid discharge pipe 301*b*, and the other port of the 3-way valve 302*a* is connected with a liquid tank 15 through a pump 303. In the same manner, two port of the 3-way valve 302*b* for discharging the liquid are connected, in parallel to the 3-way valve 302*a* for supplying the liquid, so as to couple the liquid supply pipe 301*a* and the liquid discharge pipe 301*b*, and the other port of the 3-way vale 302*b* takes back the liquid to the liquid tank 15.

In addition to the liquid tank 15, a pure water tank 16 storing the pure water for cleaning is disposed separately, and a cleaning pipe 401 is connected with two ports of 3-way valve 402*a* for supplying the water so as to couple liquid buffers 300*a* and 300*b*. In parallel to the 3-way valve 402*a* for the supplying the water, two ports of 3-way valve 402*b* for discharging the water are connected so as to couple the two liquid buffers. The other port of the 3-way valve 402*a* for supplying the water is connected to the pure water tank 16 through a pump 403, and the other port of the 3-way valve 402*b* for discharging the water takes back the water to the pure water tank 16.

The deteriorated electrolyte and the post-cleaning pure water are stored in a drainage tank 17. The liquid buffer 300*a* is connected to the liquid supply pipe 301*a* and the cleaning pipe 401 through 2-way valve 304*a*, and the liquid buffer 300*b* is connected to the liquid discharge pipe 301*b* and the cleaning pipe 401 through 2-way valve 304*b*. The 2-way valve 304*a* and the 2-way valve 304*b* are switched between the electrolytic treatment and the cleaning treatment.

<Electrolytic Treatment>

Under the above-mentioned configuration, the hollow pipe 100 is fixed on the holding frames 60 by means of the clips 201*a*, 201*b* and the flanges 111*a*, 111*b*, and then the electrode 20 is inserted in the hollow pipe from the top of the hollow pipe 100. The structure of the electrode 20 is not limited in particular, but this embodiment uses the electrode disclosed in Japanese Patent No. 5,807,938, since it needs to electro-polish a weld zone of the cell (the large diameter part, in particular). Next, the upper and lower liquid buffer 300*a* and 300*b* are liquid-tightly attached on both ends of the hollow pipe 100, and the coupling members 70 set on the electrode axis 21 of the electrode 20 is coupled with the motor 71 that is a driving unit for rotating the electrode 20.

After the preparation as described above is finished, each valve 302*a*, 302*b* constituting the valve mechanism 302 is set so as to circulate the electrolyte from the lower liquid buffer of the hollow pipe 100 to the upper liquid buffer, and then the electrolyte is supplied from the bottom of the hollow pipe 100 by the pump 303. In the state of circulating the electrolyte in the hollow pipe 100, the electrolytic treatment is started. While continuing to circulate a predetermined amount of the electrolyte per unit time, the electrolytic treatment is performed with a predetermined current for a predetermined period. The electrolytic treatment is carried out by applying a negative to the electrode 20 and a positive to the hollow pipe 100 while rotating the electrode 20 by the motor 71. Next, after temporally stopping supplying the liquid and the electrolytic treatment, the hollow pipe 100 is inversed together with the holding frames 100.

After that, the valve mechanism 302 (the 3-way valve 302*a* and 302*b*) is switched so as to circulate the electrolyte from the lower liquid buffer 300*a* to the upper liquid buffer 300*b*, and then the electrolytic treatment is performed under the same conditions (time, current) as above. Besides, the valves constituting the valve mechanism 302 indicate all valves illustrated in FIG. 3, such as the liquid supply valve 302*a*, the liquid discharge valve 302*b*, the water supply valve 402*a*, the water discharge valve 402*b*, and so on. In this embodiment, however, the valves to be switched for circulating the electrolyte are the liquid supply valve 302*a* and the liquid discharge valve 302*b*. That is to say, after inverting the hollow pipe 100, the liquid discharge valve 302*b* changes to the liquid supply valve 302*a* while the liquid supply valve 302*a* changes to the liquid discharge valve 302*b*. In order to achieve the object of the present invention, "circulating the electrolyte upward from the below", it needs to switch the liquid supply valve 302*a* and the liquid discharge valve 302*b*.

The above-mentioned electrolytic treatment can be carried out manually by inverting the hollow pipe 100, switching the valve mechanism 302, and controlling the required current and voltage, but these steps can be carried out automatically using a control unit 400. In this case, the control unit 400 inverts the hollow pipe and switches the supplying of the liquid, that is, it is sure to supply the electrolyte upward from the lower liquid buffer 300*a* and control the electrolytic treatment (time, current, and etc.).

Figure 5:
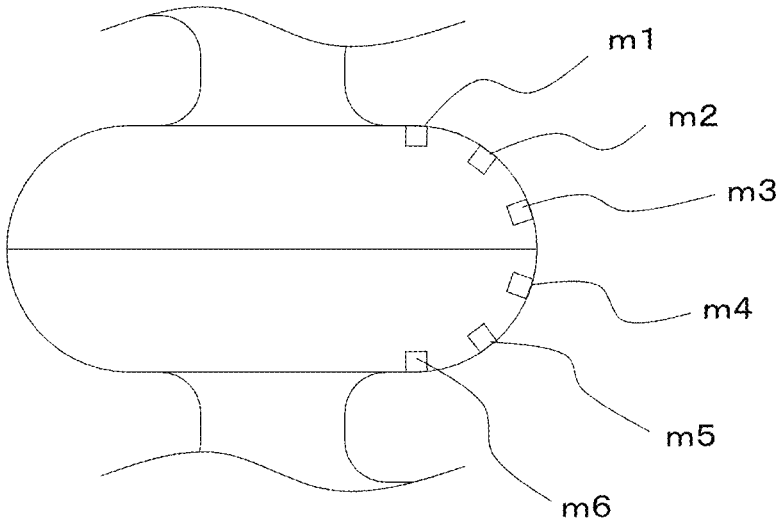
FIG. 5 is a view showing measurement positions.
Figure 6:
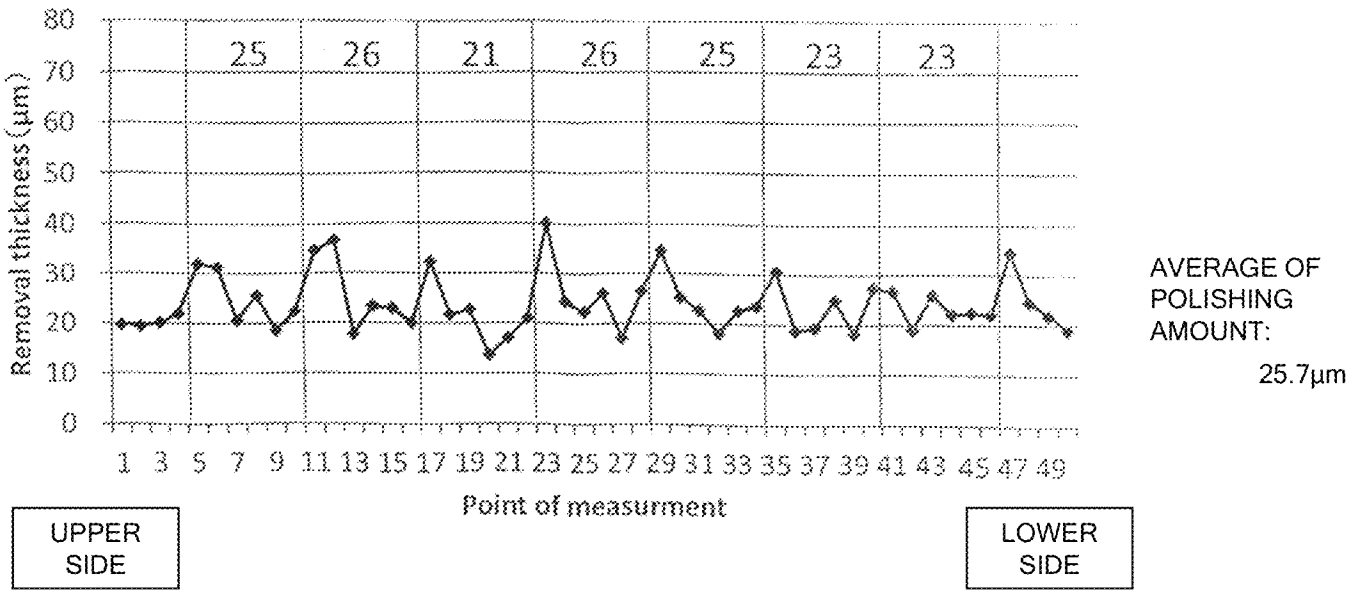
FIG. 6 shows a status of the electrolytic polishing made by the present invention.

While supplying the electrolyte from the lower end of the hollow pipe 100 at a flow rate of 5 L/min, the electrolytic treatment is carried out for 3 minutes under 200 to 270 $mA/cm^2$ and around 16 to 17 V. The electrolyte treatment is called as one processing. In addition, the processing is carried out one more time after inverting the hollow pipe 100. The processing is repeated 31 times, which is called as a unit treatment. After the plural unit treatments are carried out for the inside of the hollow pipe 100, the amount of polishing at each measurement point in FIG. 5 (m1 to m6, and in all cells) is illustrated in FIG. 6 by the average of the plural unit treatments.

The amount of polishing at the small diameter part is stable at about 20 μm, and the amount of polishing at the large diameter part is around 30 to 35 μm. Beside, in FIG. 6, the serial numbers are assigned from a top measurement point to a bottom measurement point in order (the same applies to FIGS. 7 and 8 described hereinafter).

Figure 7:
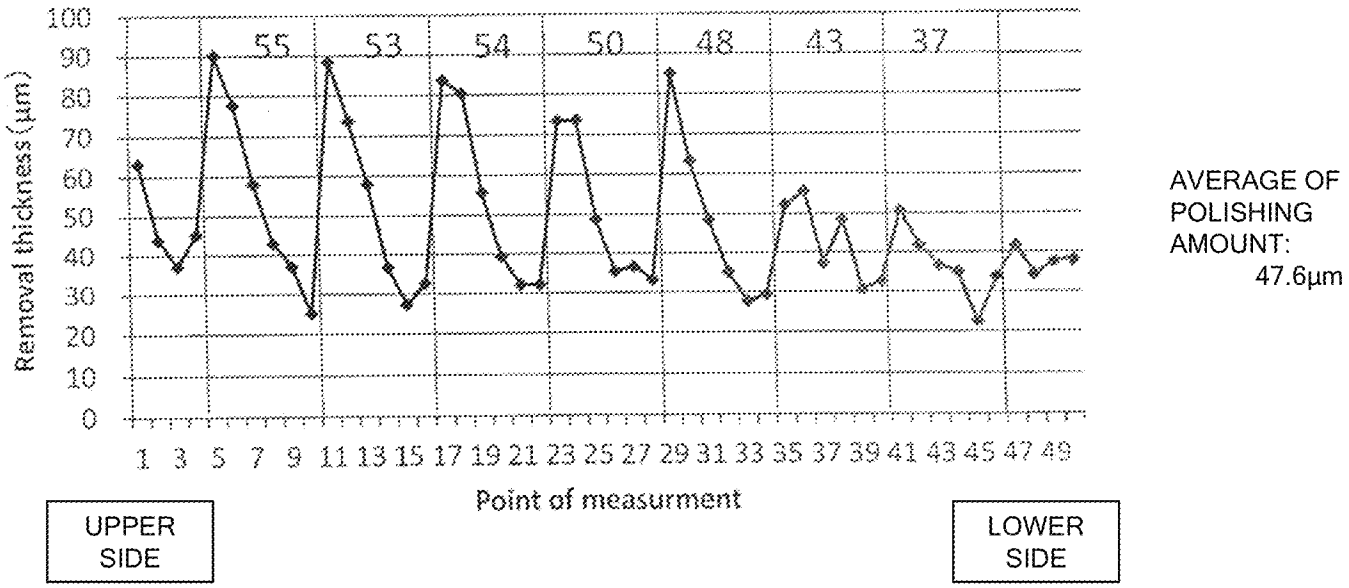
FIG. 7 shows a state of the electrolytic polishing made by a comparative example.

FIG. 7 shows a result of a comparative example. In the comparative example, the electrolytic treatment is suspended after the electrolytic treatment for a predetermined period (3 minutes) while supplying the electrolyte from the lower end of the hollow pipe 100, and then restarted after pushing out the bubbles dwelling around the shoulders of the cells while keeping supplying the electrolyte, of which treatment is repeated the same number of times as above. It is understood that the amount of polishing around the shoulder of the large diameter part becomes 80 to 90 μm, which differs 50 μm from the amount of polishing around the small diameter part.

Figure 8:
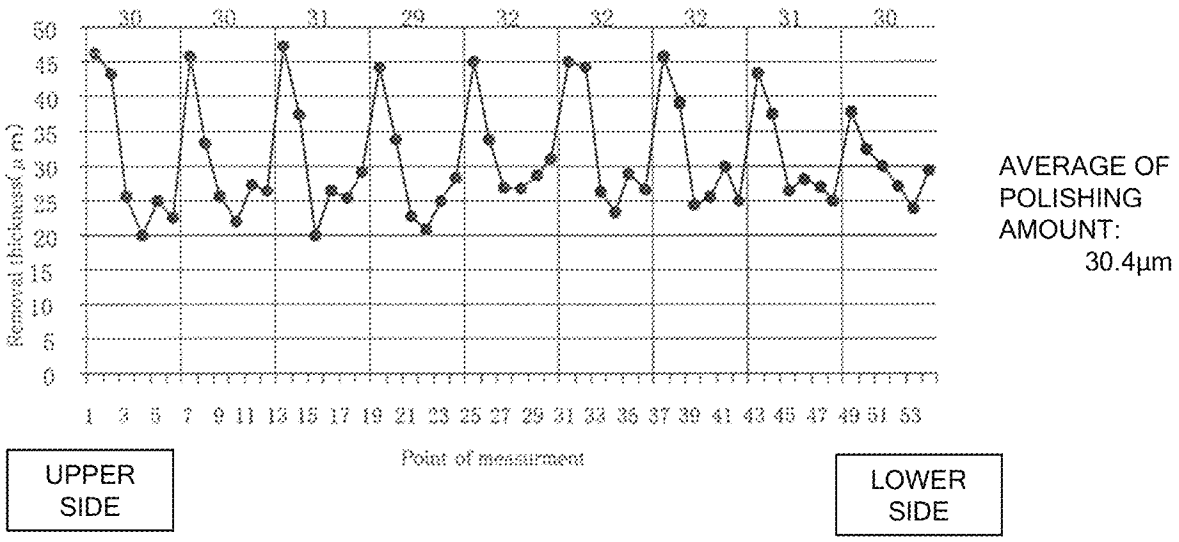
FIG. 8 shows a state of the electrolytic polishing made by an other comparative example.

FIG. 8 shows a result of the other comparative example. In the other comparative example, the electrolytic treatment and the supply of the liquid are suspended temporarily after the electrolytic treatment for the predetermined period (3 minutes same as above) while supplying the electrolyte from the lower end, and then the electrolytic treatment is carried out while supplying the electrolyte from the upper side of the hollow pipe 100. After the electrolytic treatment for the predetermined period (3 minutes), both the electrolytic treatment and the supply of the electrolyte is stopped, of which treatment is repeated the same number of times as above. The results of the treatments are show in FIG. 8. The amount of polishing of the small diameter part is 20 to 25 μm, which does not differ greatly from a case of inverting the hollow pipe 100, but the amount of polishing of the large diameter part becomes 45 μm, and the difference between the amount of polishing of the large diameter part (the positions of the shoulders of the cells) and the amount of polishing of the small diameter parts becomes large.

Figure 9A:
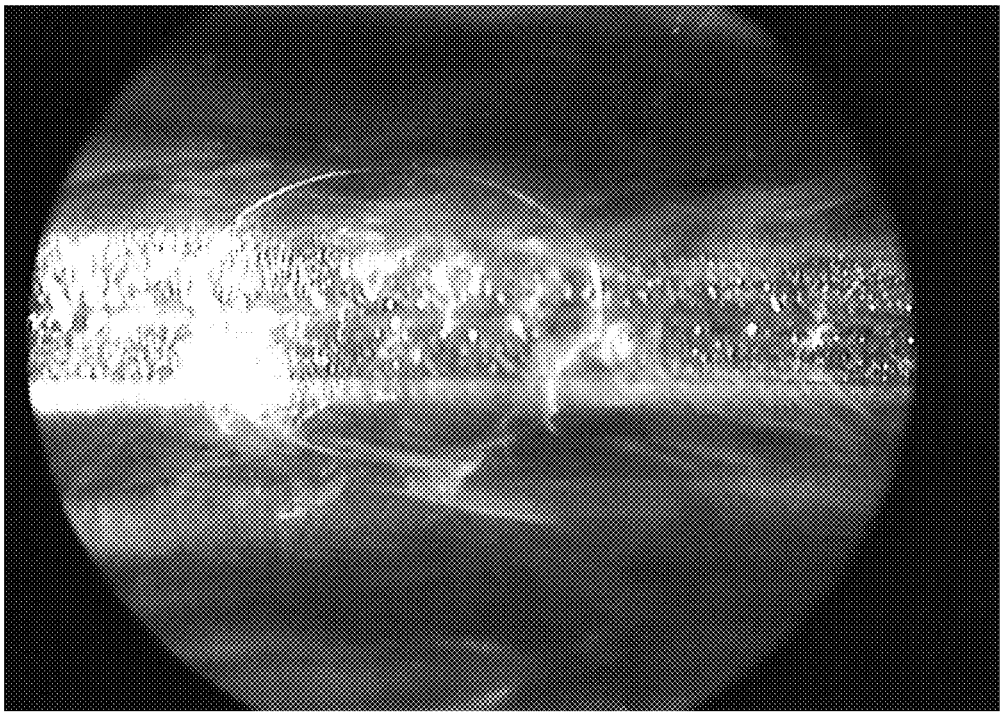
FIGS. 9(*a*) and 9(*b*) are photos showing statuses before or after the electrolytic polishing treatment by the present invention.
Figure 9B:
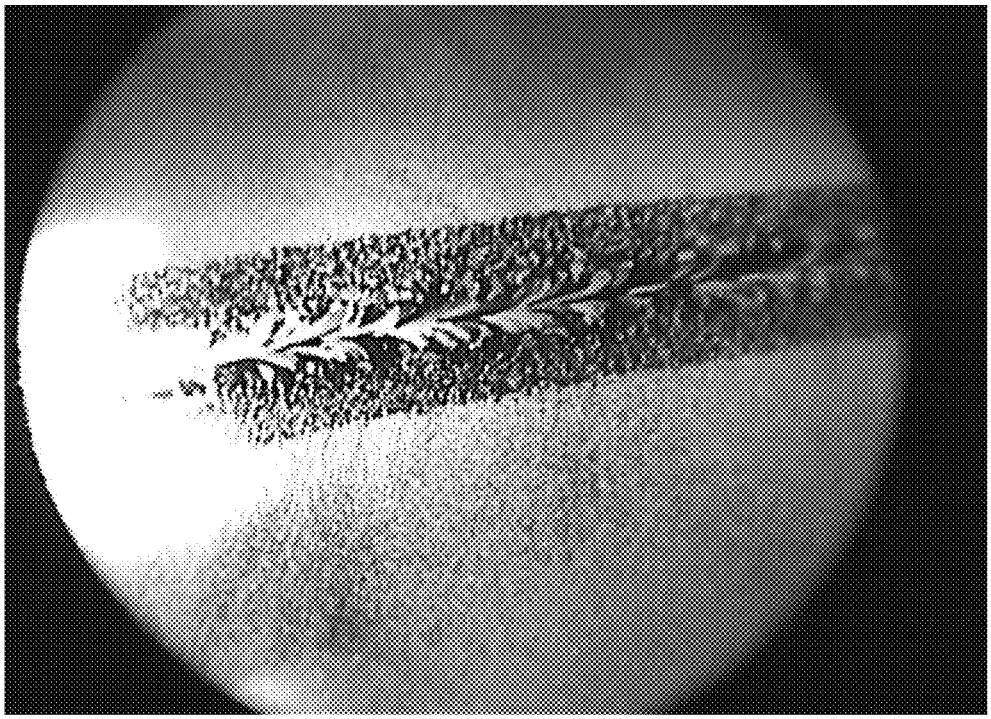
Figure 10:
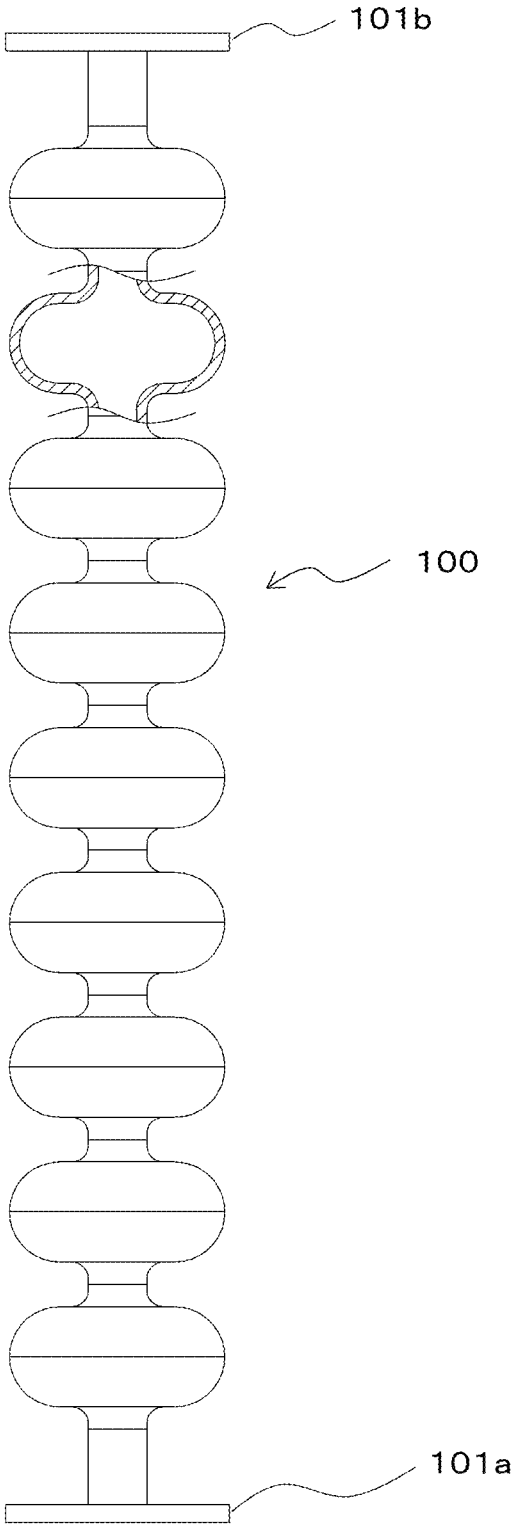
FIG. 10 is a view showing the hollow pipe.

FIG. 9 shows photos by a microscope showing a weld zone (the large diameter part) on the inside of the hollow pipe before and after the treatment in the present invention. FIG. 6 shows the effect of the present invention according to the amount of polishing of each part. FIG. 9 shows that the inside of the hollow pipe 100 is finished as mirror-finished surface, and the state of the surface becomes smooth as expected.

Specifically, the bulge part (cell) of the hollow pipe 100 is formed as follows; cup-shaped bodies cutting into halves at the largest diameter part of the cell are coupled mutually, and the coupled parts are welded. Since the light to be irradiated is diffused before the treatment of the present invention (FIG. 9(*a*)), only an unclear picture can be obtained on the whole. After the treatment (FIG. 9(*b*)), however, it is understood that the surface are finished as mirror-finished surface, the debris at the weld zone is removed completely.

Accordingly, the above described results indicate that the electrolytic treatment while inverting the hollow pipe by means of the device according to the present invention is effective.

In the above embodiment, it is defined that the time for the electrolytic treatment before the inverse is the same as the time for the electrolytic treatment after the inverse, but it may be allowed to change the time of the electrolytic treatment depending on the conditions. For instance, there are cases that the upper side of the bulge is different in shape from the lower side of the bulge, or the upper side of the bulge is different in material from the lower side of the bulge.

<Electrode>

Figure 4:
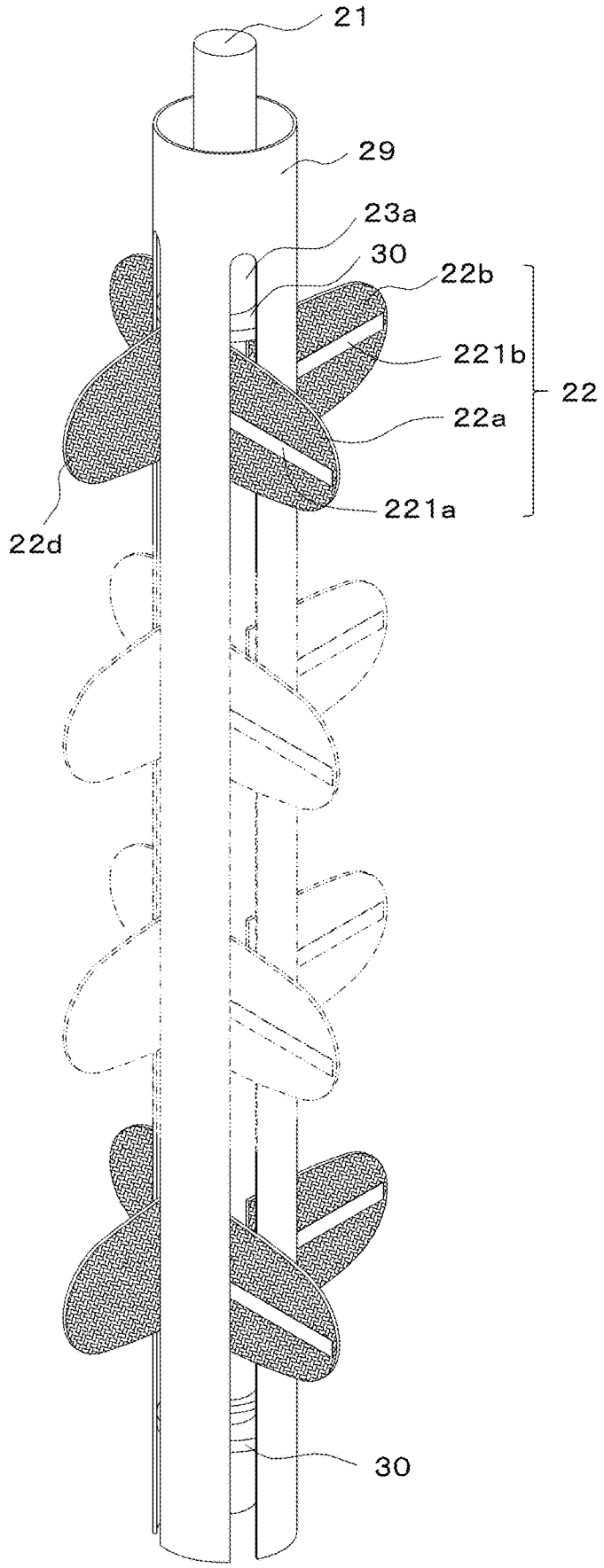
FIG. 4 is a perspective view showing an electrode used by the present invention.

The structure of the electrode is explained hereinafter briefly according to FIG. 4, since it was disclosed in Japanese Patent No. 5,807,938.

A wing electrode 22 is formed by arranging at least one or plural wings 22*a*, 22*b* . . . (4 wings shown in Figure) in a circumferential direction of the electrode axis 21 at equal intervals, and an outer edge of the wing has a shape corresponding to an inner shape of the bulge of the hollow pipe 100 to be polished.

Each wing 22*a*, 22*b* . . . constituting the wing electrode 22 has the flexibility. When the wings are wound around the electrode axis 21, the diameter of the wing electrode 22 becomes a minimum. The wing electrode 22 in such state can be housed in a housing tube 29 concentric with the electrode axis 21. The housing tube 29 is provided with a slit group 23 (slits 23*a*, 23*b* . . . ), and each slit 23*a*, 23*b* . . . is positioned so as to correspond to a tip of each wing 22*a*, 22*b* housed in the housing tube 29. The wings 22*a*, 22*b* . . . are inserted in each slit 23*a*, 23*b* . . . of the slit group 23 so as to slightly project each tip of the wings toward an outside of the housing tube 29. Under such configuration, when rotating the electrode axis 21 and the housing tube 29 relatively, the tip of each wing 22*a*, 22*b* . . . can be inserted and extracted in a radial direction. It can be configured that each diameter of the tips of wings 22*a*, 22*b* . . . is adjustable (a diameter adjusting unit: the electrode axis 21+the wing electrode 22+the housing tube 29+the slit group 23).

The wing electrode 22 changes to two modes, such as a housing state and a working state as mentioned hereinafter. Specifically, in the housing state, the tip of each wing 22*a*, 22*b* . . . is slightly projected from each slit 23*a*, 23*b* . . . of the housing tube 29, and in the working state as shown in FIG. 4, each outer edge of the wing 22*a*, 22*b* . . . is pushed out near to an internal peripheral surface of the hollow pipe 100 by relatively rotating the electrode axis 21 and the housing tube 29 (a distance between the outer edge of each wing 22*a*, 22*b* . . . and the internal peripheral surface of the hollow pipe 100 is approximately 1 cm, for example).

Since at least the outer peripheral end of each wing is made of metal and electrically connected to the electrode axis 21, when an electric field is applied between the electrode 20 and the hollow pipe 100 in the working state, the inside of the hollow pipe 100 is electro-polished.

It is needless to say that the same number of the wing electrodes 22 as the cells of the hollow pipe 100 is arranged on the electrode axis 21.

INDUSTRIAL APPLICABILITY

As described above, the electrolytic polishing in the present invention is configured to perform the electrolytic polishing of the inside of the hollow pipe by inverting the hollow pipe repeatedly at the same time of pushing out the generated bubbles by circulating the electrolyte from the lower end of the hollow pipe, so that the inside can be polished evenly, and it is very effective to apply the invention to the product requiring precise polishing like the hollow pipe for the linear collider, in particular.

DESCRIPTION OF THE REFERENCE NUMERAL

20 Electrode
21 Electrode axis
22 Wing electrode
22*a*, 22*b* Wing
23 Slit group
23*a*, 23*b* Slit
29 Housing tube
50 Rack
51*a*, 51*b* Prop
60 Holding frame
61 Rotational axis
70 Coupling member
100 Hollow pipe
111*a*, 111*b* Flange
201*a*, 202*b* Clip
300*a*, 300*b* Liquid buffer
301 Supply/discharge pipe (301*a*: Liquid supply pipe, 301*b*: Liquid discharge pipe)
302 Valve mechanism
303 Pump

The invention claimed is:

1. An electrolytic polishing device comprising:

a rack;

holding frames for vertically holding a hollow pipe, and pivotally supported on the rack so as to be vertically invertible about the vertical center of the hollow pipe;

an electrode inserted in the hollow pipe;

liquid buffers disposed at upper and lower ends of the hollow pipe; and a valve mechanism for circulating an electrolyte in the hollow pipe from a lower liquid buffer to an upper liquid buffer regardless of before and after the inversion of the invertible hollow pipe.

2. The electrolytic polishing device according to claim 1, further comprising;

a control unit for performing the electrolytic polishing for a predetermined period while circulating the electrolyte in the hollow pipe from the lower liquid buffer after setting one end of the hollow pipe downwardly and an another end of the hollow pipe upwardly, and then performing the further electrolytic polishing for the predetermined period while circulating the electrolyte in the hollow pipe from the lower liquid buffer after setting the other end of the hollow pipe downwardly and the end of the hollow tub upwardly.

3. The electrolytic polishing device according claim 1, wherein, the electrode comprises plural wing electrodes, the shape of which corresponds to an inside of the hollow pipe, and changes a housing state of winding the wing electrodes to an electrode axis, or a working state of unwinding and extending the wing electrodes to a circumferential direction.

4. The electrolytic polishing device according to claim 1, wherein, the hollow pipe is a niobium pipe having bulges periodically disposed.

5. An electrolytic polishing method using the electrolytic polishing device according to claim 1, comprising steps of:

a step of performing the electrolytic polishing for a predetermined period while circulating the electrolyte in the hollow pipe from the lower liquid buffer to the upper liquid buffer;

a step of suspending the electrolytic polishing and the supplying/discharging of the electrolyte;

a step of inverting the hollow pipe; and a step of performing the electrolytic polishing of the inversed hollow pipe for the predetermined period while circulating the electrolyte in the hollow pipe from the lower liquid buffer to the upper liquid buffer.

* * * * *